US006305035B1

(12) United States Patent
Morris

(10) Patent No.: US 6,305,035 B1
(45) Date of Patent: Oct. 23, 2001

(54) TOILET PAPER HOLDER FOR BEDSIDE COMMODE

(76) Inventor: Frances Lenore Morris, 6171 NW. 122nd Ter., Coral Springs, FL (US) 33076-1914

( * ) Notice: Subject to any disclaimer, the term of this patent is extended or adjusted under 35 U.S.C. 154(b) by 0 days.

(21) Appl. No.: 09/822,319

(22) Filed: Mar. 30, 2001

(51) Int. Cl.[7] ..... B65H 16/06

(52) U.S. Cl. ..... 4/483; 242/588; 242/598; D6/528; 4/300.1

(58) Field of Search ..... 4/483, 300.1; 242/598, 242/598.1, 598.3, 598.4, 598.5, 588, 610.4; D6/518, 519, 522, 523; 211/85.5; 248/905

(56) References Cited

U.S. PATENT DOCUMENTS

D. 180,595 * 7/1957 Gralewicz .
D. 204,595 * 5/1966 Turro .
D. 382,749 * 8/1997 Thoren et al. ..... D6/523
D. 427,829 * 7/2000 Fleming ..... D6/523
D. 431,947 * 10/2000 Kopcak et al. ..... D6/523
432,738 * 7/1890 Morgan .
2,523,951 * 9/1950 Graumlich .
3,297,265 * 1/1967 Turro .
3,622,010 * 11/1971 Renelt .
4,565,335 * 1/1986 Rankin .
5,529,260 * 6/1996 Wirick ..... 242/596.8

* cited by examiner

*Primary Examiner*—Charles R. Eloshway
(74) *Attorney, Agent, or Firm*—Robert M. Downey, P.A.

(57) ABSTRACT

A device for supporting a roll of toilet paper on a bedside commode includes a dowel pin maintained between opposite arm members. The dowel pin is specifically sized and configured for removable receipt through the hollow core tube of a conventional roll of toilet paper. The arm members extend from the dowel pin and removably attach to the frame structure of the bedside commode in a manner which supports the toilet paper roll in convenient reach of a person seated on the commode, thereby permitting sheets of paper to be pulled and separated from the roll as the roll rotates about the dowel pin.

7 Claims, 4 Drawing Sheets

TOILET PAPER HOLDER FOR BEDSIDE COMMODE

BACKGROUND OF THE INVENTION

1. Field of the Invention

The present invention relates generally to accessory devices for a bedside commode of the type including a frame structure which is adapted to support a toilet seat and removable waste receptacle and, more particularly, the present invention relates to a toilet paper roll holder for removable attachment to the frame structure of a bedside commode in a manner which conveniently maintains the roll of toilet paper within reach of the user of the bedside commode.

2. Discussion of the Related Art

It is sometimes necessary or convenient to use a portable commode next to the bed of an infirm patient. For instance, elderly persons and patients recovering from an illness or surgery sometimes lack the physical strength needed to walk unassisted from their bed to a conventional bathroom facility in order to use the toilet. It also may be more convenient for a patient to use a bedside commode if they have medical equipment connected to their bodies, such as an IV tube or respiratory device, or if they are physically impaired due to a cast or other obstruction which makes it difficult to walk to the restroom. It is, therefore, not uncommon to find the use of bedside commodes in hospitals, nursing homes, and even private residences of elderly or recovering patients.

Despite their widespread and longstanding use, bedside commodes have not heretofore been known to include means to conveniently and effectively hold a roll of toilet paper in a manner similar to that found in a conventional bathroom. Any person who has had the unfortunate need to use a bedside commode, as well as any caregiver who has assisted an infirm patient, knows all too well that the toilet paper is almost always out of reach and, many times, out of sight when it is needed. Often, patients must suffer the indignity of having to call for someone to bring them a roll of toilet paper while seated on the portable commode.

Accordingly, in view of the aforementioned shortcomings in the healthcare field, and particularly relating to the use of bedside commodes, there remains an urgent need for an inexpensive toilet paper roll holder which is particularly adapted for convenient, quick attachment to all brands and styles of bedside commodes in order to operably support a roll of toilet paper within convenient reach of a person seated on the commode.

SUMMARY OF THE INVENTION

The present invention is directed to a device for rotatably supporting a roll of toilet paper on a bedside commode. The toilet paper holder device includes a dowel pin maintained between opposite arm members and means for removably attaching the arm members to the frame of the commode. The dowel pin is specifically sized and configured for removable receipt through the hollow core tube of a conventional roll of toilet paper. The arm members extend between the frame structure and the dowel pin to thereby position and maintain the toilet paper roll in convenient reach of a person seated on the commode. The paper roll is able to rotate about the dowel pin so that sheets of paper can be pulled and separated from the roll in a manner similar to that found in a conventional bathroom facility.

OBJECTS AND ADVANTAGES OF THE INVENTION

With the foregoing in mind, it is a primary object of the present invention to provide an inexpensive device for supporting a roll of toilet paper on a bedside commode within convenient reach of a person seated on the commode.

It is a further object of the present invention to provide a toilet paper roll holder device which is adapted for attachment to all brands and styles of bedside commodes used in the healthcare industry.

It is still a further object of the present invention to provide an inexpensive device for supporting a roll of toilet paper on a bedside commode, and wherein the device is constructed of a material which is easy to keep clean and free of germs with use of available household disinfectant products.

It is still a further object of the present invention to provide a device for supporting a roll of toilet paper on a bedside commode, and wherein the device is easily and quickly attachable to either arm of the commode.

It is still a further object of the present invention to provide an inexpensive device for supporting a roll of toilet paper on a bedside commode, and wherein the device is adapted to permit easy loading and replacing of rolls of toilet paper as needed.

It is still a further object of the present invention to provide a device which rotatably supports a roll of toilet paper on a bedside commode in a manner which permits sheets of paper to be conveniently pulled and separated from the roll by a person seated on the commode.

These and other objects and advantages of the present invention are more readily apparent with reference to the drawings and detailed description which follows.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
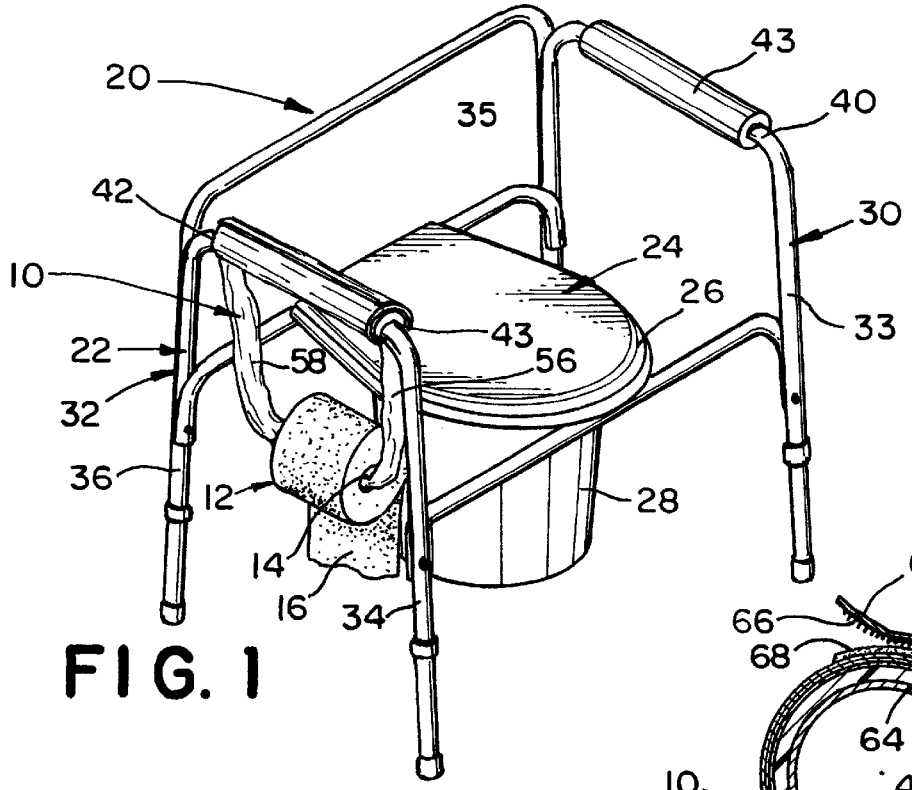
FIG. 1 is a top front perspective view of a bedside commode showing a preferred embodiment of the toilet paper roll holder secured to the right arm rest of the bedside commode, to thereby rotatably support and conveniently position a roll of toilet paper within reach of a person seated on the bedside commode.

Referring initially to FIGS. 1–3 and 6, a first preferred embodiment of the device is shown and is generally indicated as 10. The device 10, directed to a toilet paper roll holder, is particularly adapted for removable attachment to the frame structure 22 of a portable commode 20 for rotatably supporting a conventional roll of toilet paper 12 within convenient reach of a person seated on the commode. As seen in FIG. 1, the portable bedside commode 20 includes a generally tubular frame structure 22 which is typically made of aluminum or other high strength, lightweight material. The frame structure 22 is specifically adapted to support a potty 24, including a hinged seat and lid 26 and a removable waste receptacle 28. Typically, the frame structure of a conventional bedside commode, of the type shown in FIG. 1, includes a left frame portion 30 and a right frame portion 32. Both the left and right frame portions 30, 32 are provided with forward vertical legs 33, 34 and rear vertical legs 35, 36, respectively. The left and right frame portions 30, 32 also include arm rests 40, 42 extending between the respective front and rear legs. In many instances, an arm rest pad 43 is fitted to the arm rests 40, 42, as seen in FIG. 1. And, while it is contemplated within the spirit and scope of the invention to provide means for attaching the various embodiments of the toilet paper roll holder device to any part of the frame structure 22 of the portable commode 20, the various preferred embodiments herein are shown attached to either the left or right arm rests 40, 42.

Figure 2:
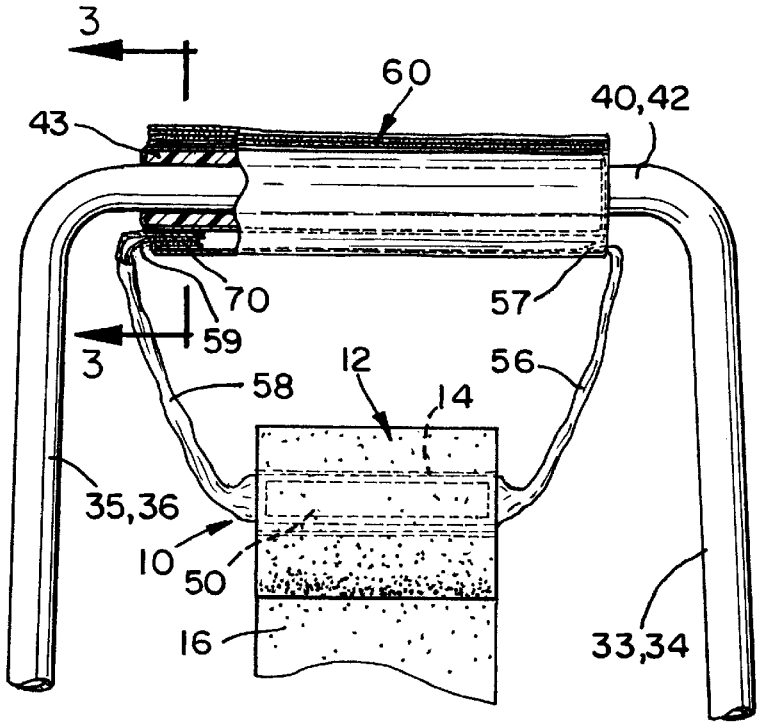
FIG. 2 is an isolated elevational view, in partial section, showing the toilet paper roll holder of FIG. 1 secured to the arm rest of the bedside commode.
Figure 3:
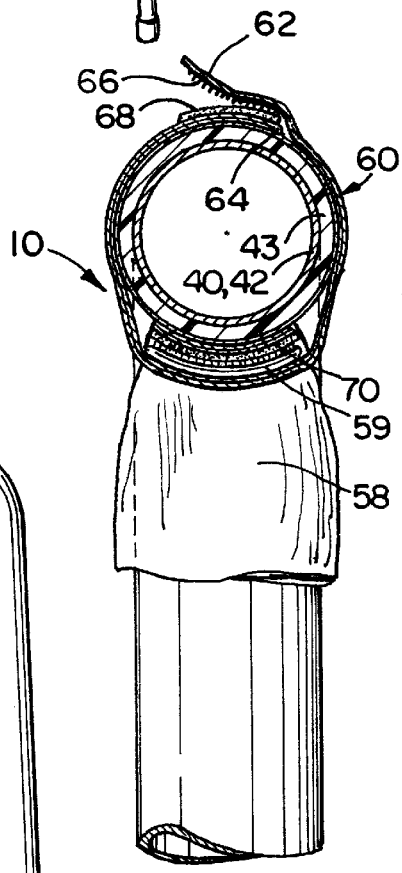
FIG. 3 is a sectional view taken along the plane of the line 3—3 of FIG. 2.
Figure 4:
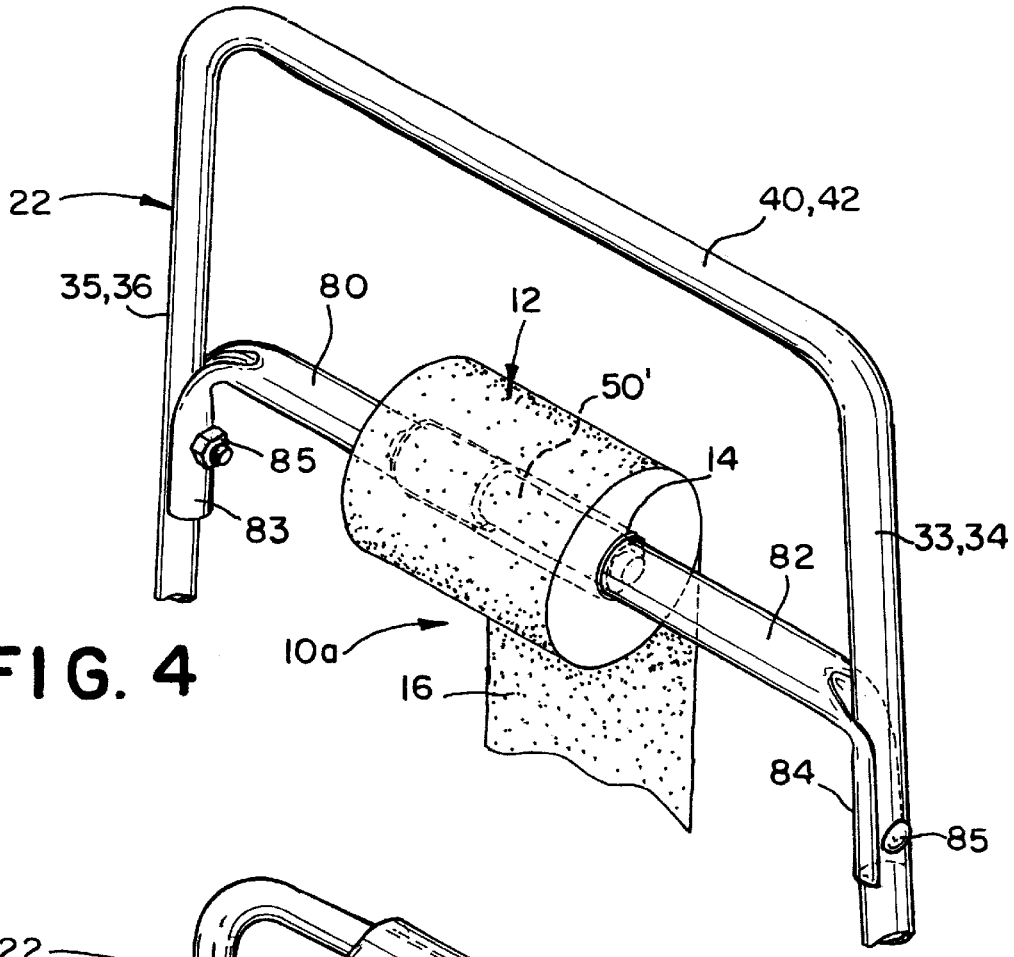
FIG. 4 is an isolated perspective view of an alternative embodiment of the toilet paper roll holder secured to the frame structure of a conventional bedside commode.

In the first preferred embodiment, as seen in FIGS. 1–3, and 6, the toilet paper roll holder device 10 includes a dowel pin 50 which is captured within a sleeve of material 52. The dowel pin 50 may be manufactured of wood, plastic, metal or other like rigid material and is specifically sized and configured for receipt through the hollow tubular core 14 of a conventional roll of toilet paper 12. The sleeve section 53 is stitched at seams 53, on opposite sides of the dowel pin 50, to thereby captivate the dowel pin 50 within the sleeve section 52. Arm members 56, 58 extend from the stitched seam to respective distal ends 57, 59. In a preferred embodiment, the arm members 56, 58 are integrally formed with the sleeve section 52, all of the same material, preferably vinyl. Attachment means 60 are provided for removably attaching the device 10 to the frame structure 22 of the chair. In a preferred embodiment, the device 10 is secured to either of the arm rests 40, 42 and, particularly about the arm rest pads 43. In the embodiment shown in FIGS. 1–3 and 6, the attachment means 60 includes a panel of material 61, preferably vinyl, having opposite side edge zones 62, 64. Hook and loop fasteners 66, 68 are provided along the respective side edge zones 62, 64, and on opposite sides of the panel, so that the panel of material 61 can be wrapped about the arm rest of the commode and secured using the hook and loop fasteners 66, 68 which mate in overlying engagement, as seen in FIG. 3.

The distal end 57 of the arm member 56 is fixedly secured to the panel 61, by stitching, so that the arm member 56 extends downwardly from the panel 61 when the panel 61 is secured about the arm rest of the commode. The distal end 59 of the opposite arm member 58 is provided with releasable attachment means 70 for releasably attaching the distal end 59 to the panel 61 of material. When the device 10 is completely attached and secured, the dowel pin 50 and sleeve 52 are maintained in spaced relation below the arm rest, with the dowel pin 50 extending generally parallel with the arm rest, as seen in FIGS. 1 and 2.

In a preferred embodiment, hook and loop fasteners 72, 74 are provided on the distal end 59 of the arm member 58 and the panel of material 61, respectively. This permits removable attachment of the distal end 59, so that the roll of toilet paper 12 can be loaded onto the device and positioned about the dowel pin and sleeve 52 and then removed when empty to permit easy replacement with a new roll of paper. Specifically, the distal end 59 is easily detached from the panel 61, thereby enabling the distal end 59 of the arm member 58 to be passed through the hollow tubular core of the toilet paper roll 12 so that the roll can be slid along the length of the arm 59 and positioned about the sleeve section 52 and dowel pin 50, as seen in FIGS. 1 and 2. Using the releasable fastening means 70, the distal end 59 is then reattached to the panel 60. Preferably, this is accomplished by opening the panel 61, to separate the opposite edge zones 62, 64, thereby exposing the loop material 74. Once the distal end 59 is attached, by mating the hook material 72 with the loop material 74, the panel material is wrapped about the arm rest pad 43 and the opposite edge zones 62, 64 are reattached, using the hook and loop fasteners 66, 68. Once secured to the commode, as seen in FIGS. 1 and 2, sheets 16 of toilet paper can be pulled from the roll 12, as the roll 12 is permitted to freely rotate about the sleeve section 52 and dowel pin 50. The device 10 is particularly suited to conveniently position the roll 12 relative to a person seated on the potty 24 of the commode. In a preferred embodiment, the panel 61, as well as the arm members 56, 58 and sleeve section 52 are all manufactured of a vinyl material which is easy to clean with any suitable household disinfectant product. Use of a soft, flexible material, such as vinyl, also reduces the likelihood of accidental injury should a person using the commode fall against the toilet paper roll holder device 10 when attempting to sit or stand.

Referring to FIGS. 4, 5, 7 and 8, several alternative embodiments of the device are shown and indicated as 10*a*–10*d*. Specifically, in FIG. 4, the toilet paper roll holder device 10*a* includes opposite arm members 80, 82 which are formed in a generally L-shape to provide a mounting flange 83, 84, respectively. The mounting flange 83, 84 of each of the arm members 80, 82 is specifically shaped and configured for mating engagement with the frame structure 22 of the commode, such as to the forward and rear vertical legs so that the arm members 80, 82 extend inwardly towards one another generally parallel to and below the arm rest 40, 42. Fasteners, such as conventional bolts and nuts 85 are used to secure the flange portions 83, 84 of the respective arm members 80, 82 to the frame structure 22. A spring loaded dowel 50', similar to that found on a conventional toilet paper roll holder, is fitted between the opposing arm members 80, 82 and held in place, to thereby rotatably support the roll of toilet paper 12 thereon.

Figure 5:
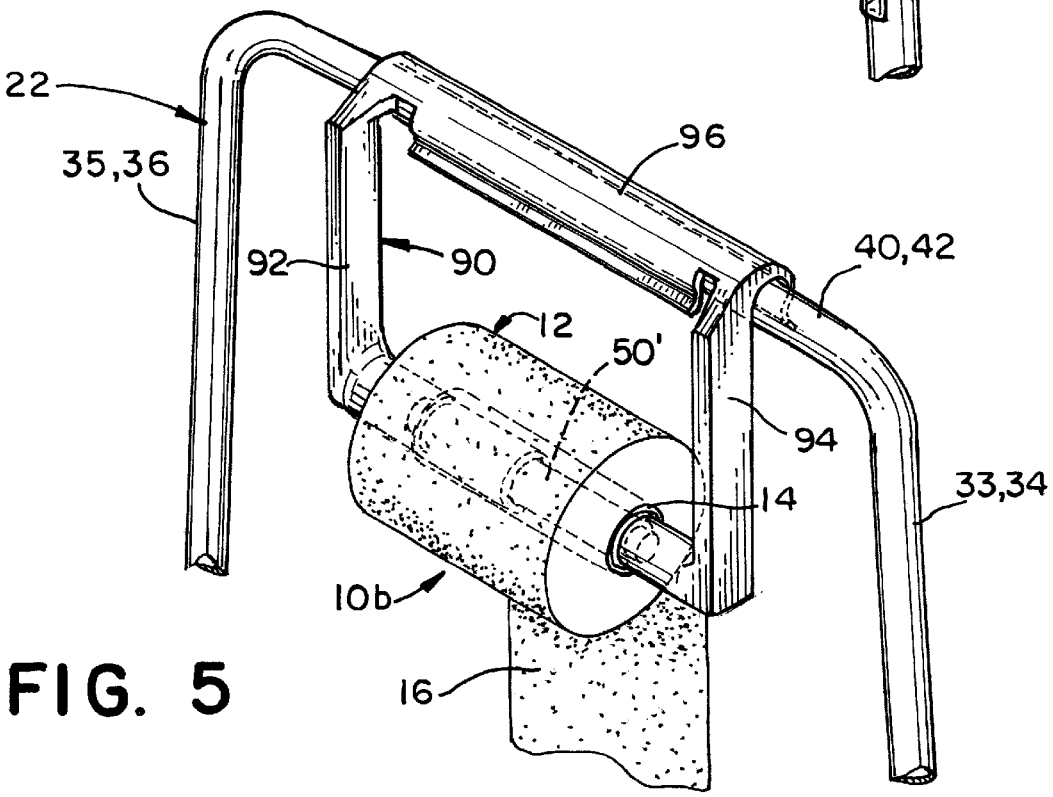
FIG. 5 is an isolated perspective view showing yet another embodiment of the toilet paper roll holder removably attached to the frame structure of a conventional bedside commode.
Figure 6:
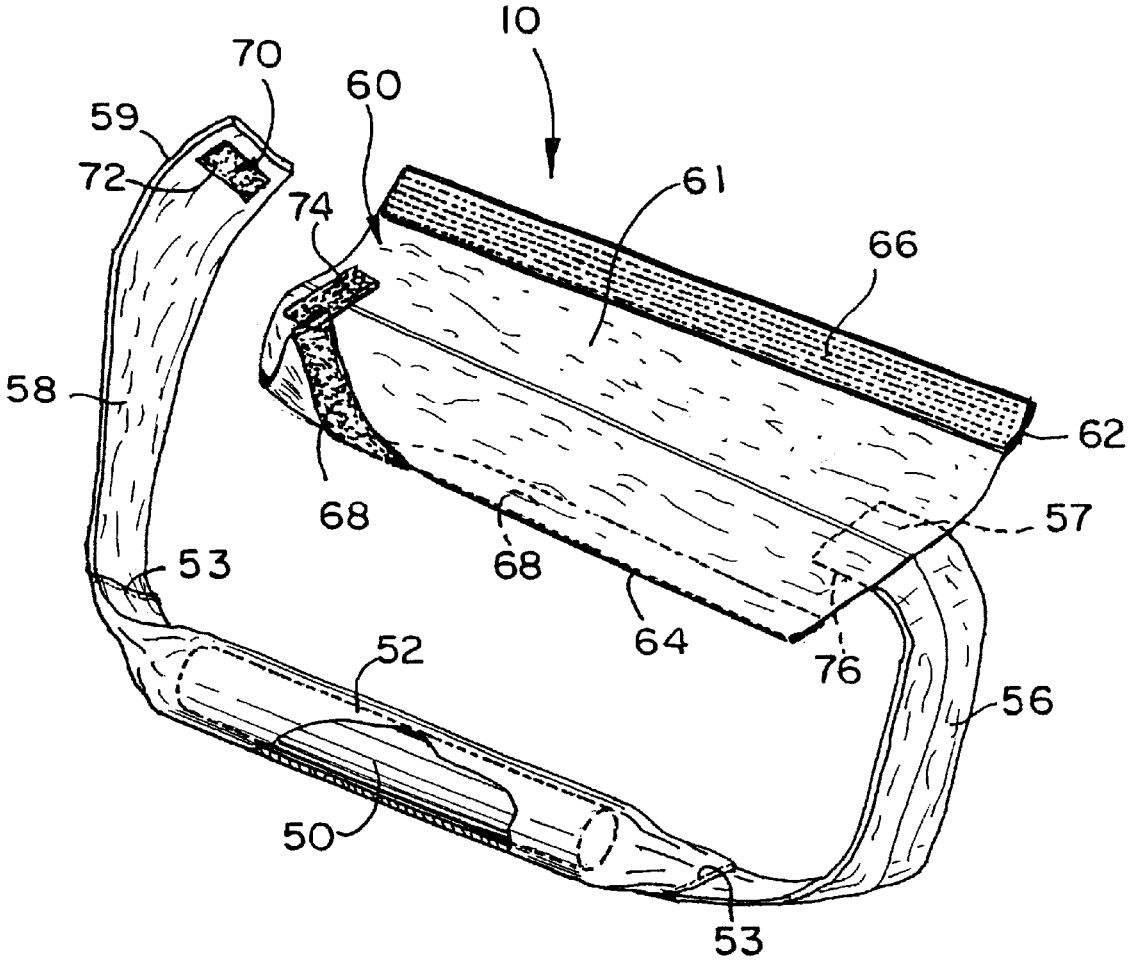
FIG. 6 is a top perspective view of the preferred embodiment of the toilet paper roll holder of FIGS. 1–3, shown removed from the arm rest of the bedside commode.

Referring to FIG. 5, another embodiment of the toilet paper roll holder device is shown and generally indicated as 10*b*. In this particular embodiment, the device 10*b* includes a one-piece structure 90 including opposite downwardly extending arm members 92, 94 and a mounting clip 96 integral with and spanning between the upper ends of the arm members 92, 94. The mounting clip 96 is specifically shaped and configured for snap fit engagement over the tubular rail structure of the arm rest 40, 42 and is provided with a memory which maintains grasping pressure about the tubular rail of the frame structure 22 (e.g., either of the arm rests) to thereby hold the device 10*b* in place so that the arm members 92, 94 extend downwardly below the arm rest. Each of the arm members 92, 94 are provided with inwardly directing portions with sockets for receipt of opposite distal ends of the spring loaded dowel 50', in the manner similar to that found on a conventional toilet paper roll holder. As seen in FIG. 5, the roll of toilet paper 12 is rotatably supported on the spring loaded dowel 50' spanning between the arm members 92, 94.

Figure 7:
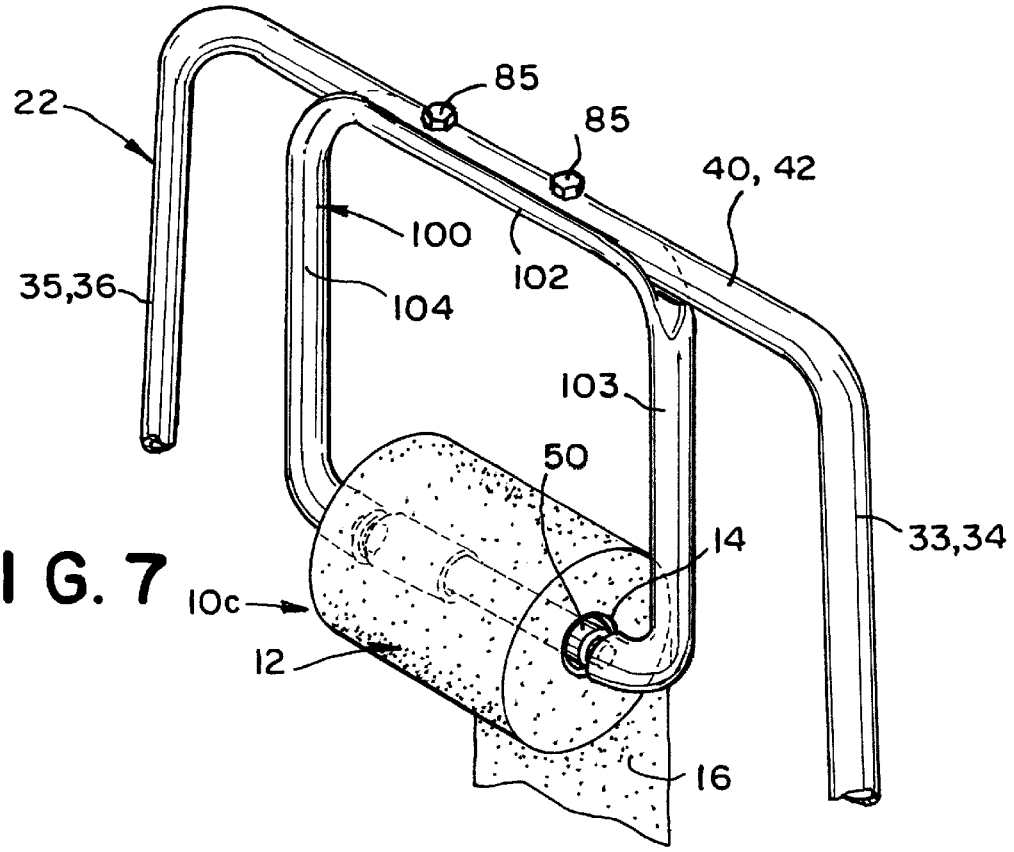
FIG. 7 is an isolated perspective view showing still another embodiment of the invention attached to the frame structure of a commode.

Referring to FIG. 7, yet another embodiment of the toilet paper roll holder device is shown and is generally indicated as 10*c*. In this particular embodiment, the device 10*c* includes a generally U-shaped structure 100 formed of the same tubular material as the frame structure 22 of the commode. The U-shaped structure 100 includes opposite, downwardly extending arm members 103, 104 and a mounting flange, defining the base of the U-shaped configuration, spanning between the opposite arm members 103, 104. The mounting flange 102 is specifically formed and configured for congruent, mating receipt with the under side of the tubular rail structure of the frame structure 22, and preferably below either of the arm rests 40, 42. Conventional fasteners 85, such as bolts and nuts, are used to secure the flange portion 102 to the frame structure 22 of the commode. Similar to the embodiment described in connection with FIG. 5, the lower ends of the arm members 103, 104 are directed inwardly and are provided with opposing sockets for receipt of opposite distal ends of the spring loaded dowel 50' therein, so that the dowel 50' spans between the arm members 103, 104. In this manner, the roll of toilet paper 12 is rotatably supported on the dowel 50' below the arm rest 40, 42.

Figure 8:
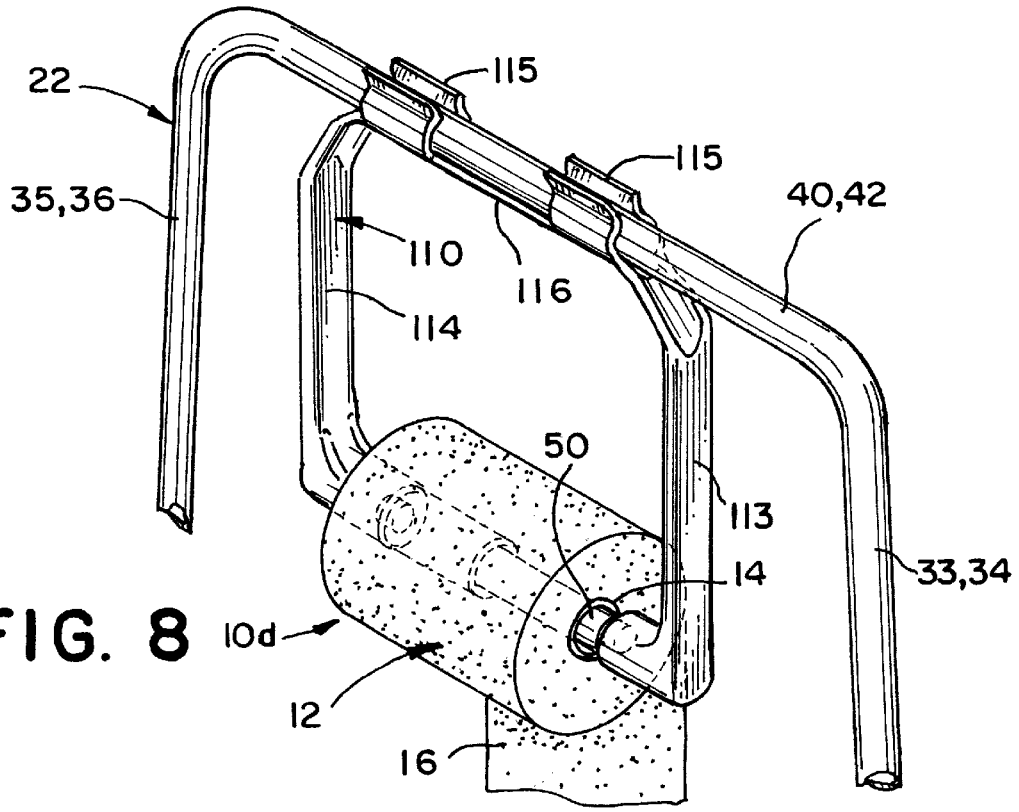
FIG. 8 is an isolated perspective view showing yet a further embodiment of the invention attached to the commode frame structure.

Referring to FIG. 8, a further embodiment of the present invention is shown and is generally indicated as 10*d*. Specifically, the device 10*d* includes an integral, one-piece molded device 110 including opposite, downwardly extending arm members 113, 114 and a mounting portion 116 extending between the respective arm members 113, 114 to define a generally U-shaped configuration similar to that of the embodiment of FIG. 7. The device 10*d* is preferably molded of a plastic material as a one-piece, integral structure and includes clips 115 extending from the mounting portion 116 for snap fit, grasping engagement of the tubular structure of the frame structure 22, and preferably to either of the arm rests 40, 42. Similar to the embodiments of FIGS. 7 and 5, the respective arm members 113, 114 each include inwardly directed portions with opposing sockets for receipt of opposite distal ends of the spring loaded dowel 50' so that the dowel 50' extends between the arm members. In this manner, the roll of toilet paper 12 is rotatably supported on the dowel 50' below the arm rest 40, 42 as seen in FIG. 8.

While the instant invention has been shown and described in connection with various embodiments thereof, it is recognized that departures from the instant disclosure are contemplated within the spirit and scope of the present invention as set forth in the following claims and as interpreted under the doctrine of equivalents.

What is claimed is:

1. A device for holding a roll of toilet paper on a portable commode and wherein the portable commode includes a frame structure; said device comprising:

a pair of arm members each including a first end zone and an opposite second end zone;

a dowel pin being structured and configured for removable receipt through said roll of toilet paper so that said roll of toilet paper is able to rotate about said dowel pin;

a sleeve surrounding said dowel pin and supporting said dowel pin from said arm members so that said dowel pin extends between said first end zones of said respective arm members; and means for attaching said second end zones of said arm members to said frame structure of said commode.

2. The device as recited in claim 1 wherein said sleeve is structured and disposed to support said dowel pin in horizontal extending position between said arm members.

3. The device as recited in claim 2 wherein said sleeve is formed of a flexible material.

4. The device as recited in claim 3 wherein said sleeve is integral with said pair of arm members.

5. The device as recited in claim 4 wherein said arm members are formed of the same flexible material as said sleeve.

6. The device as recited in claim 5 wherein said means for attaching includes a flexible material panel having opposite side edge zones and means for releasable attachment of said opposite side edge zones in mating, overlying relation to one another, thereby permitting said panel to be wrapped and secured about said frame structure of said portable commode.

7. The device as recited in claim 6 wherein said second end zone of at least one of said pair of arm members includes means for removable attachment to said material panel of said attaching means.

* * * * *